US005973293A

United States Patent [19]

Reichman

[11] Patent Number: 5,973,293

[45] Date of Patent: Oct. 26, 1999

[54] SYSTEM FOR CONTROLLING THE INTERNAL TEMPERATURE OF AN ICE SKATE BOOT

[76] Inventor: Sandra E. Reichman, 25 Sarenee Cir., Trumbull, Conn. 06611

[21] Appl. No.: 09/073,949

[22] Filed: May 7, 1998

[51] Int. Cl.[6] ..... A63C 5/04; A43B 7/02

[52] U.S. Cl. ..... 219/211; 219/201; 219/209; 280/608; 36/2.6

[58] Field of Search ..... 219/201, 209, 219/211, 482, 507, 527; 280/11.18, 608, 841; 36/2.6, 119; 604/113

[56] References Cited

U.S. PATENT DOCUMENTS

| | | | |
|---|---|---|---|
| 3,866,927 | 2/1975 | Tvengsberg | 219/201 |
| 3,977,093 | 8/1976 | Santroch | 36/2.6 |
| 4,404,460 | 9/1983 | Kerr | 219/211 |
| 4,418,928 | 12/1983 | Cox . | |
| 4,638,578 | 1/1987 | Eiteljorg, II | 36/119 |
| 4,655,465 | 4/1987 | Schaffer . | |
| 4,697,360 | 10/1987 | Sartor | 36/2.6 |
| 4,837,494 | 6/1989 | Maier | 219/211 |
| 5,255,929 | 10/1993 | Lemelson | 280/11.18 |
| 5,360,227 | 11/1994 | Lemelson | 280/608 |
| 5,441,305 | 8/1995 | Tabar | 219/211 |
| 5,769,434 | 6/1998 | Wurthner | 280/11.18 |
| 5,829,171 | 11/1998 | Weber et al. | 36/2.6 |

*Primary Examiner*—Tu Ba Hoang
*Assistant Examiner*—Fadi H. Dahbour
*Attorney, Agent, or Firm*—Ronald Reichman

[57] ABSTRACT

A ice skate boot that keeps the skaters feet warm. Thermal insulators are placed between the mounting plates and the sole of the boot. Thus, the amount of heat transfer between the boot, bracket and blade is reduced. Hence, the skaters feet are warmer and the skater is more comfortable. In an alternate embodiment of the invention a heater is placed in the interior of the boot and the skater may adjust the amount of heat emitted by the heater.

4 Claims, 5 Drawing Sheets

SYSTEM FOR CONTROLLING THE INTERNAL TEMPERATURE OF AN ICE SKATE BOOT

FIELD OF THE INVENTION

The invention relates generally to ice skates, and more particularly to controlling the internal temperature of ice skate boots.

BACKGROUND OF THE INVENTION

Ice skating is not only a means of travel on ice. It is also a well established sport and recreational activity. Ice skating is essential in the game of ice hockey, and the sports of figure skating and speed skating. The typical ice skate known in the prior art generally includes a single narrow blade extending longitudinally and connected subjacently to brackets that are connected to the sole of a shoe or boot that is secured to the foot of the skater. The blade and brackets are typically made of metal and are in direct contact with the ice and the boot of the skate is generally exposed to cold air. Thus, the feet of the skaters typically become cold causing the skater to become uncomfortable. The forgoing reduces the skaters skating proficiency as well as reducing the amount of time the skater is on the ice.

Our bodies direct knowledge of heat is provided by the sensation of hotness or coldness the body receives when it comes in contact with various physical substances. A person's sensations of heat is qualitative and is considerably influenced by the substance a person comes in contact with. Every substance is in some measure a conductor of heat, though liquids are poor conductors and gasses almost non-conductors. The best conductors are metals. The flux of heat through a layer of any substance by conduction is proportional to the temperature gradient (fall of temperature per unit thickness) and to a factor called the "thermal conductivity" of the substance. The thermal conductivity is the heat flow across a surface per unit area per unit time divided by the negative of the ratio of the change of temperature with distance in a direction perpendicular to the surface. Thus, on a frosty day a piece of metal feels considerably colder than a piece of leather although the two are presumably at the same temperature. Temperature changes are produced by the addition or subtraction of heat from a object. Hence, temperature may be regarded as a measure of the concentration or intensity of heat. In general, the more heat that is it added to body the more the temperature rises.

Previously, skaters kept their feet warm by wearing thick leather boots and warm socks. One of the problems encountered with socks was that the thickness and number of the socks worn by the skater had to be constant so that the skaters feet would fit properly within the boot. Since, the temperature was not always the same sometimes the skaters foot would be cold and at other times the skaters foot would be warm. Thus, a disadvantage of the prior art was that skaters had difficulty in keeping their feet warm.

An additional disadvantage of the prior art was that the skater was unable to adjust the temperature inside the boot of the skate to the skaters desired temperature.

SUMMARY OF THE INVENTION

This invention overcomes the disadvantages of the prior art by providing a ice skate boot that keeps the skaters feet warm. An additional advantage of this invention is that the skater is able to adjust the temperature inside the boot to a temperature that the skater desires.

The apparatus of this invention accomplishes the forgoing by providing thermal insulators between the mounting plates and the sole of the boot. Thus, the amount of heat transfer between the boot, mounting plate and blade is reduced. Hence, the skaters feet are warmer and the skater is more comfortable.

In an alternate embodiment of this invention sensors and heaters are provided to enable the skater to adjust the internal temperature of the boot.

DETAILED DESCRIPTION OF THE PREFERRED EMBODIMENT

Figure 1:
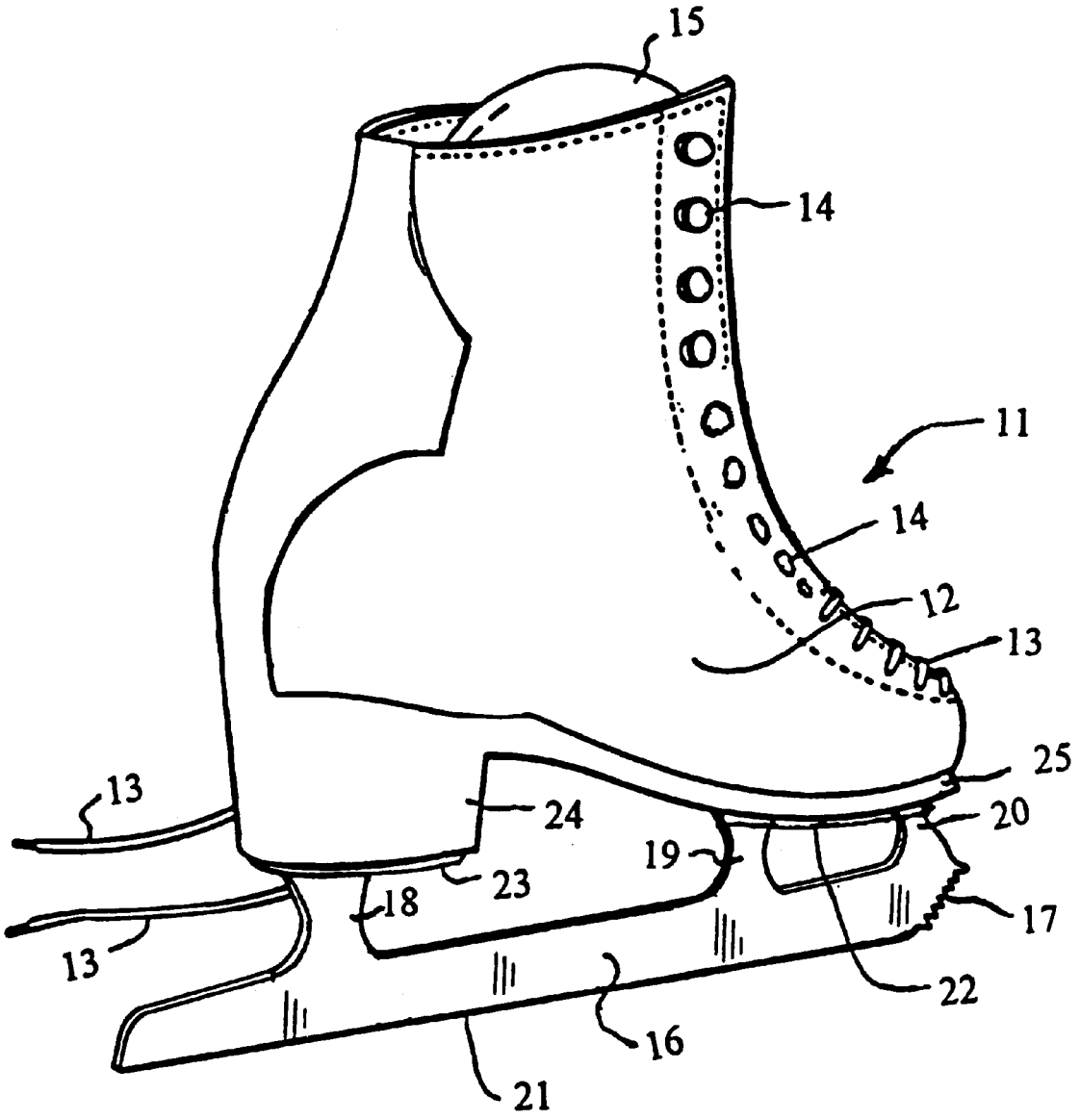
FIG. 1 PRIOR ART
FIG. 1 is a perspective drawing of a prior art figure skate.

Referring now to the drawings in detail and more particularly to FIG. 1, the reference character 11 represents a prior art ice skate in the form of a figure skate. It will be obvious to one skilled in the art that this invention is equally applicable to hockey skates, speed skates or other forms of skates. Skate 11 includes: a boot 12 adapted to receive and secure the foot of the skater when lace 13 is inserted in eyelets 14 and tied (not shown); a tongue 15; a blade 16 having a toe pick 17 at its front end and posts 18, 19 and 20 that are perpendicular to cutting edge 21 of blade 16; a front mounting plate 22 and a rear mounting plate 23. Plates 22 and 23 are respectively secured to sole 25 and heel 24 of boot 12 by rivets or other fasteners commonly employed in the construction of skates.

Figure 2:
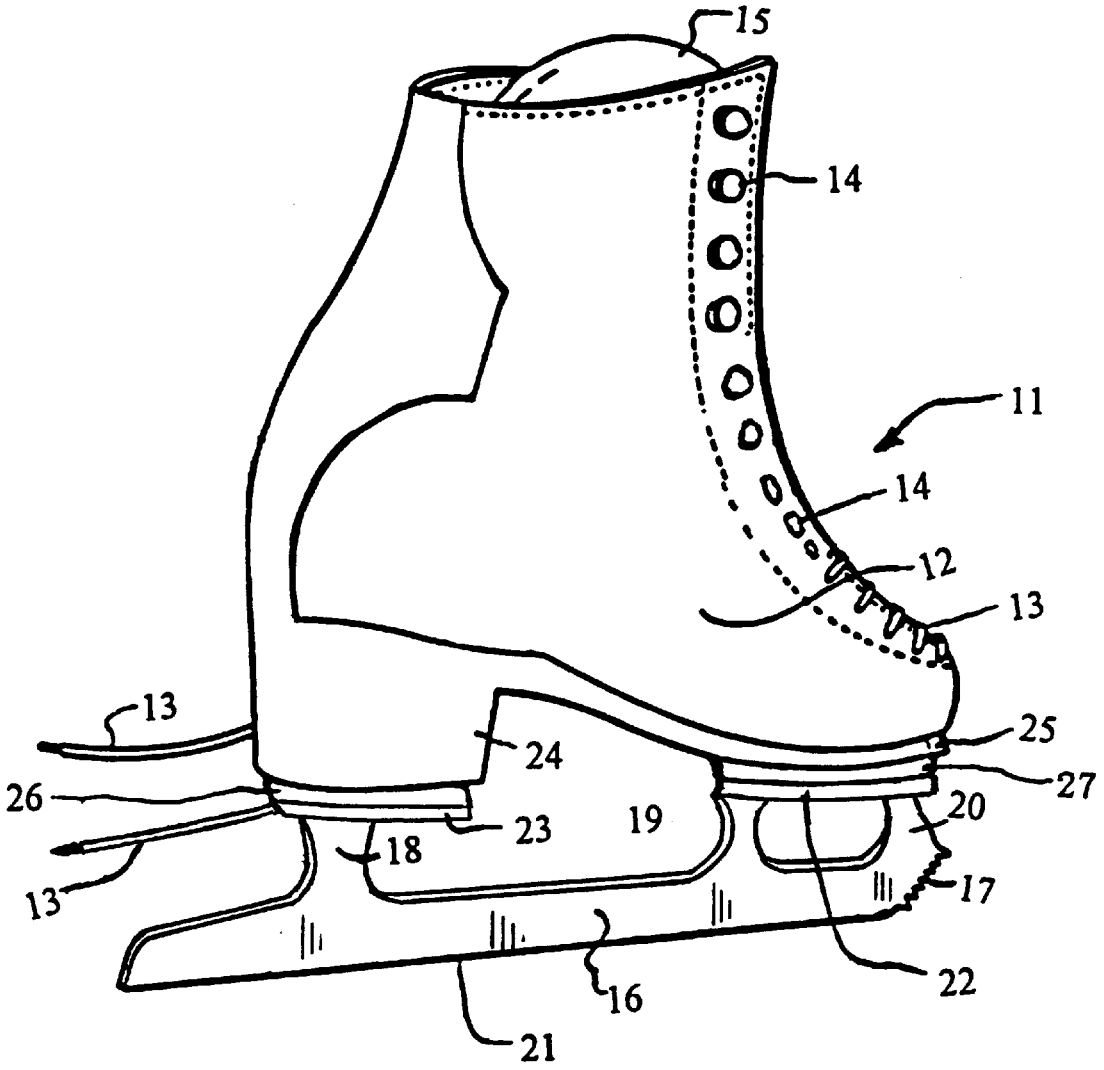
FIG. 2 is a perspective drawing of the apparatus of this invention.

FIG. 2 is a perspective drawing of the apparatus of this invention depicting ice skate 11 shown in FIG. 1, with insulators 26 and 27. Insulator 26 is positioned between back plate 23 and heel 24 and insulator 27 is positioned between front plate 22 and sole 25. Insulator 27 and plates 22 and insulator 26 and plate 23 are respectively secured to sole 25 and heel 24 of boot 12 by rivets or other fasteners commonly employed in the construction of skates. Insulators 26 and 27 provide thermal insulation between blade 16 and heel 24 and sole 25 of boot 12. Thus, the amount of heat transfer between boot 12, plate 22 and 23 and blade 16 is reduced. Hence, the skaters feet are warmer and the skater is more comfortable.

Figure 3:
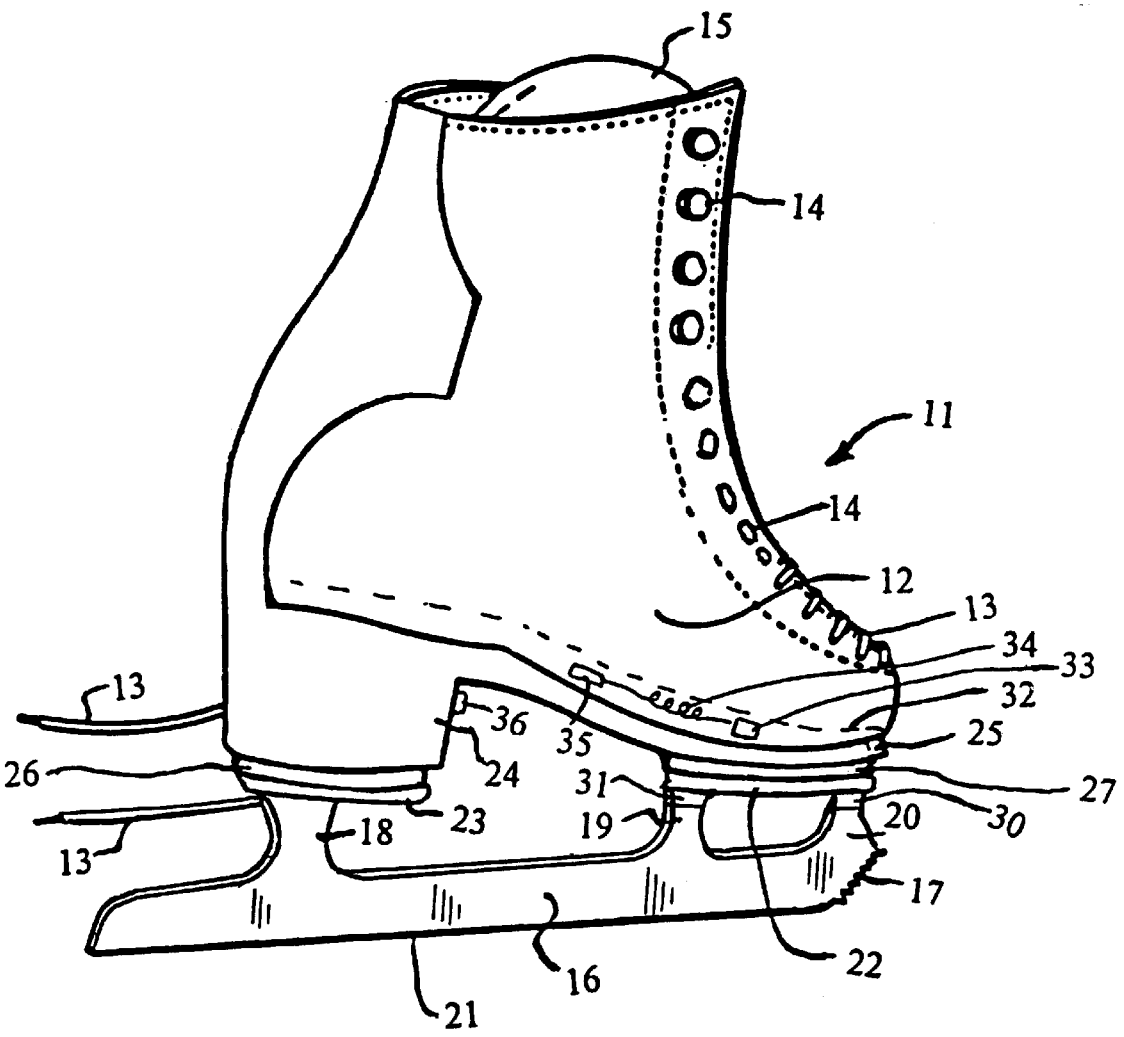
FIG. 3 is a perspective drawing of an alternate embodiment of this invention that provides sensors and a heater to enable the skater to adjust the internal temperature of the boot.

FIG. 3 is a perspective drawing of an alternate embodiment of this invention that provides sensors and a heater to enable the skater to adjust the internal temperature of the boot. FIG. 3 shows ice skate 11 described in FIG. 2, with temperature sensors 30, 31, 33, heater 34, battery 35, switch or rheostat 36 and foot pad 32. The operation and connection of temperature sensors 30, 31, 33, heater 34, battery 35 and switch or rheostat 36 will be more fully described in the description of FIG. 4. Temperature sensors 30 and 31 are affixed to plate 22 and/or insulator 27 in a manner that sensors 30 and 31 would be able to sense the temperatures of posts 19 and 20. Temperature sensor 33, heater 34 and battery 35 are positioned between foot pad 32 and sole 25 of boot 11 in a manner that sensor 33 will be able to sense the temperature of the toe portion of boot 11 and heater 34 will be able to raise the internal temperature of boot 11. Switch 36 is affixed to heel 24.

Figure 4:
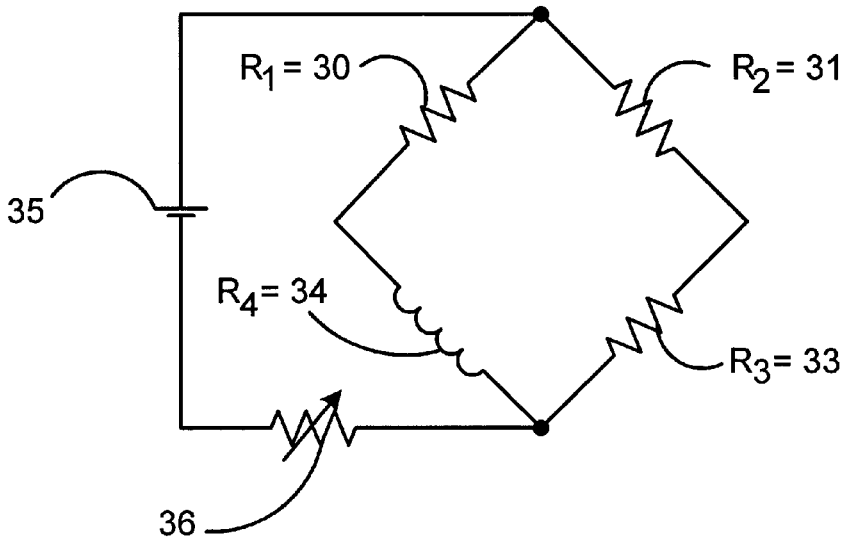
FIG. 4 is a circuit that shows the operation and connection of temperature sensors 30, 31, 33, heater 34, battery 35 and variable switch 36 of FIG. 3.

FIG. 4 is a circuit that shows the operation and connection of temperature sensors 30, 31, 33, heater 34, battery 35 and variable switch 36 of FIG. 3. One of the ends of sensor 30 is connected to one of the ends of sensor 31 and to one of the terminals of battery 35. The other end of sensor 31 is connected to one of the ends of sensor 33. The other end of sensor 33 is connected to one of the ends of heater 34 and one of the ends of variable switch or rheostat 36. The other end of heater 34 is connected to one of the ends of sensor 30. The other end of rheostat 36 is connected to one of the terminals of battery 35.

Temperature sensors 30, 31, 33, heater 34, battery 35 and variable switch 36 form a Wheatstone bridge circuit. Sensor 30 may be $R_1$, sensor 31 may be $R_2$, sensor 33 may be $R_3$ and heater 34 may be $R_4$. Hence, $$R_4 = \frac{R_1 R_3}{R_2}$$

Thus, the user of boot 11 may adjust switch 36 so that heater 34 will emit an amount of heat that keeps the feet of the skater warm.

Figure 5:
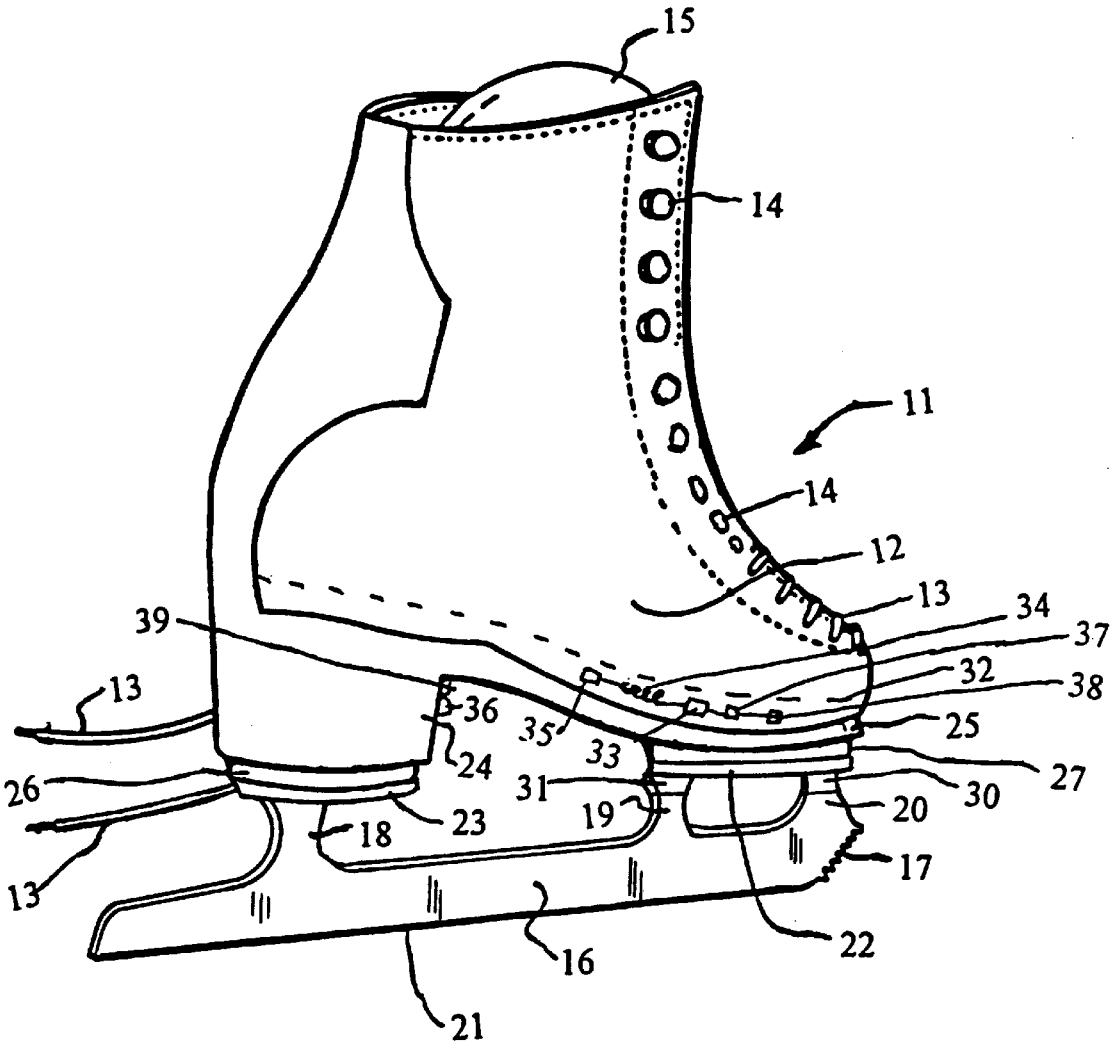
FIG. 5 is a is a perspective drawing of an alternate embodiment of the invention shown in FIG. 3 that enables the skater to more quickly adjust the internal temperature of the boot.

FIG. 5 is a is a perspective drawing of an alternate embodiment of the invention shown in FIG. 3 that enables the skater to more quickly adjust the internal temperature of the boot. FIG. 5 shows ice skate 11 described in FIG. 2, with temperature sensors 30, 31, 33, heater 34, battery 35, switch or rheostat 36 foot pad 32, diode 37, resistor 38 and amplifier 39. The operation and connection of temperature sensors 30, 31, 33, heater 34, battery 35, switch or rheostat 36, diode 37, resistor 38 and amplifier 39 will be more fully described in the description of FIG. 6. Temperature sensors 30 and 31 are affixed to plate 22 and/or insulator 27 in a manner that sensors 30 and 31 would be able to sense the temperatures of posts 19 and 20. Temperature sensor 33, heater 34, battery 35, diode 37 and resistor 38 are positioned between foot pad 32 and sole 25 of boot 11 in a manner that sensor 33 will be able to sense the temperature of the toe portion of boot 11 and heater 34 will be able to raise the internal temperature of boot 11. Switch 36 and amplifier 39 are affixed to heel 24.

Figure 6:
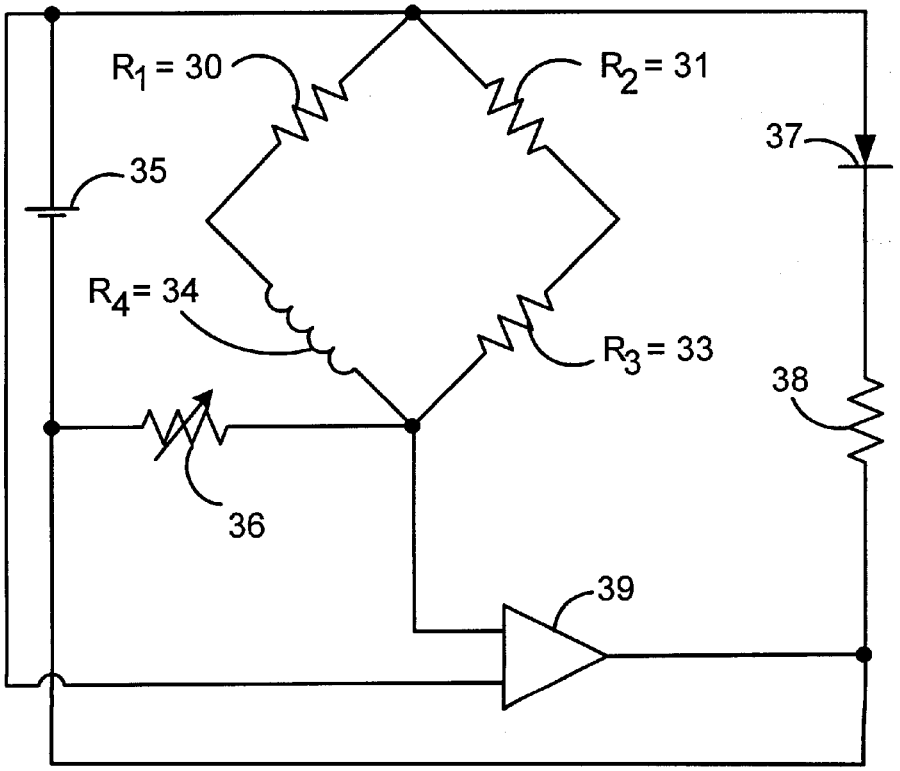
FIG. 6 is a circuit that shows the operation and connection of the electrical components shown in FIG. 5.

FIG. 6 is a circuit that shows the operation and connection of the electrical components shown in FIG. 5. One of the ends of sensor 30 is connected to one of the ends of sensor 31 and to one of the terminals of battery 35. The other end of sensor 31 is connected to one of the ends of sensor 33, one of the inputs of amplifier 39. The other end of sensor 33 is connected to one of the ends of heater 34 and one of the ends of variable switch or rheostat 36. The other end of heater 34 is connected to one of the ends of sensor 30 and to one of the inputs of apllifier 39. The other end of rheostat 36 is connected to one of the terminals of battery 35. The output of amplifier 39 is connected to one of the ends of switch 36. The output of amplifier 39 is also connected to one of the ends of resistor 38. The other end of resistor 38 is connected to one of the ends of diode 37. The other end of diode 37 is coupled to one of the ends of sensor 30 and one of the ends of sensor 31.

Temperature sensors 30, 31, 33, heater 34, battery 35 and variable switch 36 form a Wheatstone bridge circuit. Sensor 30 may be $R_1$, sensor 31 may be $R_2$, sensor 33 may be $R_3$ and heater 34 may be $R_4$. Hence, $$R_4 = \frac{R_1 R_3}{R_2}$$

Amplifier 39 acts as a comparator to allow on/off operation of heater 34 based upon the sensed temperature. The output voltage of amplifier 39 is linear with changing temperature.

Thus, the user of boot 11 may adjust switch 36 so that heater 34 will quickly emit an amount of heat that keeps the feet of the skater warm.

The above specification describes a new and improved ice skate that keeps the skaters feet warm. The skater is also able to adjust the temperature inside the boot so that the skater will be comfortable.

It is realized that the above description may indicate to those skilled in the art additional ways in which the principles of this invention may be used without departing from the spirit. It is, therefore, intended that this invention be limited only by the scope of the appended claims.

What is claimed is:

1. A ice skate of the type having a blade that is secured to a sole of a boot by a first and second mounting plate, wherein the improvement comprises:

a insulating material that is interposed between the sole and one or more of the mounting plates to reduce the exchange of heat between the interior of the boot and the blade; and means for adjusting the internal temperature of the boot, wherein the adjusting means comprises, means located in the interior of the boot for heating the boot, means located in the proximity of the blade for sensing the temperature of the blade, means located in the boot for sensing the temperature of the boot, means coupled to the heating means for regulating the amount of heat emitted by the heating means, wherein the regulating means comprises: a variable switch coupled to the heating means and the electrical energy supplying means; and a comparator having a first input that is coupled to the switch, the boot sensing means and the heating means and a second input that is coupled to the the boot sensing means and the blade sensing means and the electrical energy supplying means and a output that is coupled to the electrical energy supplying means and the switch, whereby the comparator compares its first and second inputs and means coupled to the regulating means for supplying electrical energy to the adjusting means.

2. The skate claimed in claim 1, wherein the blade sensing means comprises:

a first sensor located in the proximity of the first mounting plate; and a second sensor located in the proximity of the second mounting plate.

3. The skate claimed in claim 1, wherein the boot sensing means comprises:

a sensor located under a foot pad of the boot, wherein the foot pad is positioned on top of the sole of the boot.

4. The skate claimed in claim 1, wherein the regulating means means further includes:

a resistor having one end coupled to the output of the comparator; and a diode having one end coupled to the other end of the resistor and the other end of the diode coupled to the boot sensing means and the blade sensing means and the electrical energy supplying means, whereby the resistor and diode biases the comparator.

* * * * *